US007980413B2

(12) United States Patent
Yuan et al.

(10) Patent No.: US 7,980,413 B2
(45) Date of Patent: Jul. 19, 2011

(54) BASE FOR METALLIC CONTAINER

(75) Inventors: Sherry Yuan, Tinley Park, IL (US); Marion Grabowski, Lemont, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 1027 days.

(21) Appl. No.: 11/782,749

(22) Filed: Jul. 25, 2007

(65) Prior Publication Data

US 2009/0026214 A1 Jan. 29, 2009

(51) Int. Cl.
*B65D 6/28* (2006.01)

(52) U.S. Cl. ..... 220/608; 72/348; 220/66; 220/70; 220/606

(58) Field of Classification Search ..... 220/608, 220/66, 70, 606; 72/348
See application file for complete search history.

(56) References Cited

U.S. PATENT DOCUMENTS

| | | | | |
|---|---|---|---|---|
| 4,412,627 | A | 11/1983 | Houghton et al. | |
| 4,515,284 | A * | 5/1985 | Lee et al. | 220/606 |
| 4,685,582 | A | 8/1987 | Pulciani et al. | |
| 4,834,256 | A * | 5/1989 | McMillin | 220/606 |
| 5,105,973 | A | 4/1992 | Jentzsch et al. | |
| 6,131,761 | A | 10/2000 | Cheng et al. | |
| 6,132,155 | A | 10/2000 | Gouliard et al. | |
| 6,182,852 | B1 | 2/2001 | Szwargulski et al. | |
| 6,220,073 | B1 | 4/2001 | Cheng et al. | |

FOREIGN PATENT DOCUMENTS

EP 0482586 4/1992

OTHER PUBLICATIONS

Description of Mommy I'm Here child locator found on www.mommyimhere.com, Nov. 24, 2005, pp. 1-3.

* cited by examiner

*Primary Examiner* — Anthony Stashick
*Assistant Examiner* — Elizabeth Volz
(74) *Attorney, Agent, or Firm* — Knoble Yoshida & Dunleavy, LLC

(57) ABSTRACT

An improved metallic can has an integral base that defines a standing ring that is more resistant to buckling than conventional designs. It includes a vertically oriented cylindrical sidewall and a unitary end wall having a recessed central portion and a downwardly flanged rim portion that defines the standing ring. The downwardly flanged rim portion preferably includes a first outer convexly curved annular surface that when viewed in vertical cross-section has a first radius of curvature R1, a second, lower convexly curved annular surface that when viewed in vertical cross-section has a second radius of curvature R2, and a third, inner convexly curved annular surface that when viewed in vertical cross-section has a third radius of curvature R3. Advantageously, the first, second and third radii of curvature R1, R2 and R3 are each different from each other.

13 Claims, 2 Drawing Sheets

BASE FOR METALLIC CONTAINER

BACKGROUND OF THE INVENTION

1. Field of the Invention

This invention relates generally to metallic containers and more specifically to lightweight metallic containers that are formed by the drawing and ironing process so as to have a substantially cylindrical vertically upstanding sidewall and an integral base that defines a standing ring.

2. Description of the Related Technology

Conventional metallic cans that are manufactured using the drawing and ironing process are typically fabricated from aluminum, although other metals such as steel could alternatively be used. Aluminum possesses ductility characteristics and can easily be drawn into a cylindrical configuration and ironed to a comparably thin wall thickness.

One popular conventional base design for such metallic cans is characterized by a domed end wall having a downwardly oriented peripheral flange that defines a standing ring on which the can may be supported on an underlying horizontal surface.

The packaging industry is very competitive, and the ability to reduce material costs through lightweighting is extremely important. Accordingly, there is considerable competition within the industry to design metallic can configurations that possess the necessary performance characteristics while using an absolute minimum of material. However, the thinner that the domed end wall of the container is manufactured the more likely it is to buckle outwardly under elevated pressures, such as the pressures that may be encountered during the pasteurization and subsequent handling of carbonated beverages such as beer.

Typically, the downwardly extending standing ring flanges of conventional aluminum can designs were characterized by a relatively constant radius in the area that defined the standing ring. While such designs provided adequate performance characteristics at certain wall thicknesses, there is a continuing desire in the industry to reduce those wall thicknesses in order to save material costs.

A need accordingly existed in the industry for an improved base design for metallic containers that provides enhanced resistance against buckling and other deformation as well as the minimization of material costs.

SUMMARY OF THE INVENTION

Accordingly, it is an object of the invention to provide an improved base design for metallic containers that provides enhanced resistance against buckling and other deformation as well as the minimization of material costs.

In order to achieve the above and other objects of the invention, a metallic can according to a first aspect of the invention includes a vertically oriented cylindrical sidewall and an end wall that is unitary with the cylindrical sidewall, the end wall including a recessed central portion and a downwardly flanged rim portion that defines a substantially circular standing ring, and where the downwardly flanged rim portion includes a first outer convexly curved annular surface that when viewed in vertical cross-section has a first radius of curvature R1, a second, lower convexly curved annular surface that when viewed in vertical cross-section has a second radius of curvature R2, and a third, inner convexly curved annular surface that when viewed in vertical cross-section has a third radius of curvature R3, and wherein the first, second and third radii of curvature R1, R2 and R3 are each different from each other.

A metallic can according to a second aspect of the invention includes a vertically oriented cylindrical sidewall; and an end wall that is unitary with the cylindrical sidewall, the end wall comprising a recessed central portion and a downwardly flanged rim portion that defines a substantially circular standing ring, and wherein the downwardly flanged rim portion includes a first outer convexly curved annular surface having a first curvature, the first outer convexly curved annular surface when viewed in vertical cross-section subtending a first angle; a second, lower convexly curved annular surface having a second curvature, the second lower convexly curved annular surface when viewed in vertical cross-section subtending a second angle; a third, inner convexly curved annular surface having a third curvature, the third inner convexly curved annular surface when viewed in vertical cross-section subtending a third angle, and wherein the first, second and third angles are each different from each other.

A metallic can that is constructed according to a third aspect of the invention includes a vertically oriented cylindrical sidewall; and an end wall that is unitary with the cylindrical sidewall, the end wall comprising a recessed central portion and a downwardly flanged rim portion that defines a substantially circular standing ring, and wherein the downwardly flanged rim portion comprises a first convexly curved annular surface that has a first radius of curvature, a second convexly curved annular surface that is located inwardly of the first convexly curved annular surface and that has a second radius of curvature, and wherein the second radius of curvature is greater than the first radius of curvature.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
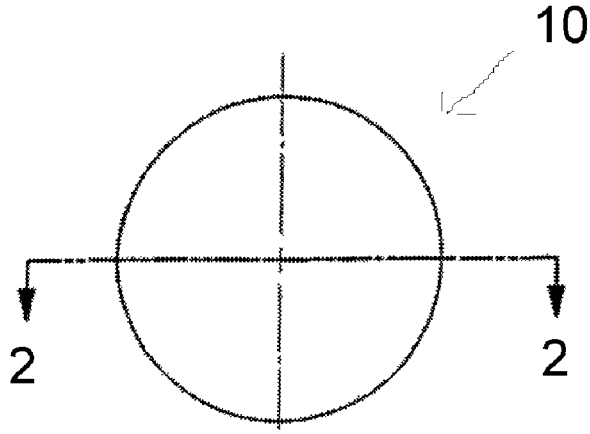
FIG. 1 is a diagrammatical top plan view of a metallic can that is constructed according to a preferred embodiment of the invention.
Figure 2:
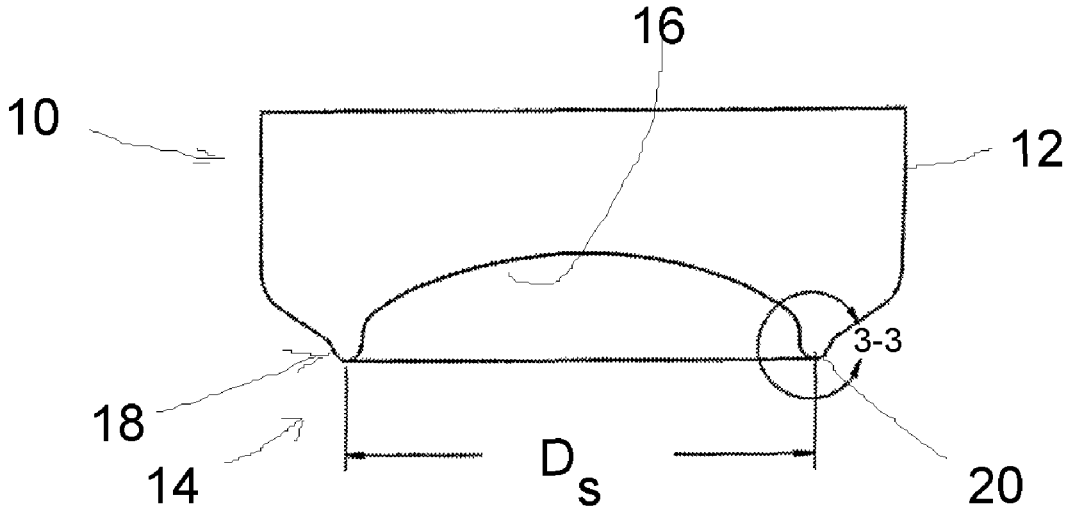
FIG. 2 is a cross-sectional view taken along lines 2-2 in FIG. 1.

Referring now to the drawings, wherein like reference numerals designate corresponding structure throughout the views, and referring in particular to FIG. 1, a metallic can 10 that is constructed according to a preferred embodiment of the invention includes a generally vertically oriented cylindrical sidewall 12 and a bottom end wall 14 that preferably includes a recessed or domed central portion 16. The bottom end wall 14 further includes a downwardly flanged rim portion 18 that defines a substantially circular standing ring 20.

Metallic can 10 is preferably fabricated from aluminum, but could alternatively be fabricated from steel or any other suitable metallic material. Metallic can 10 is preferably formed using the drawn wall iron process with which those skilled in the art will be familiar.

Figure 3:
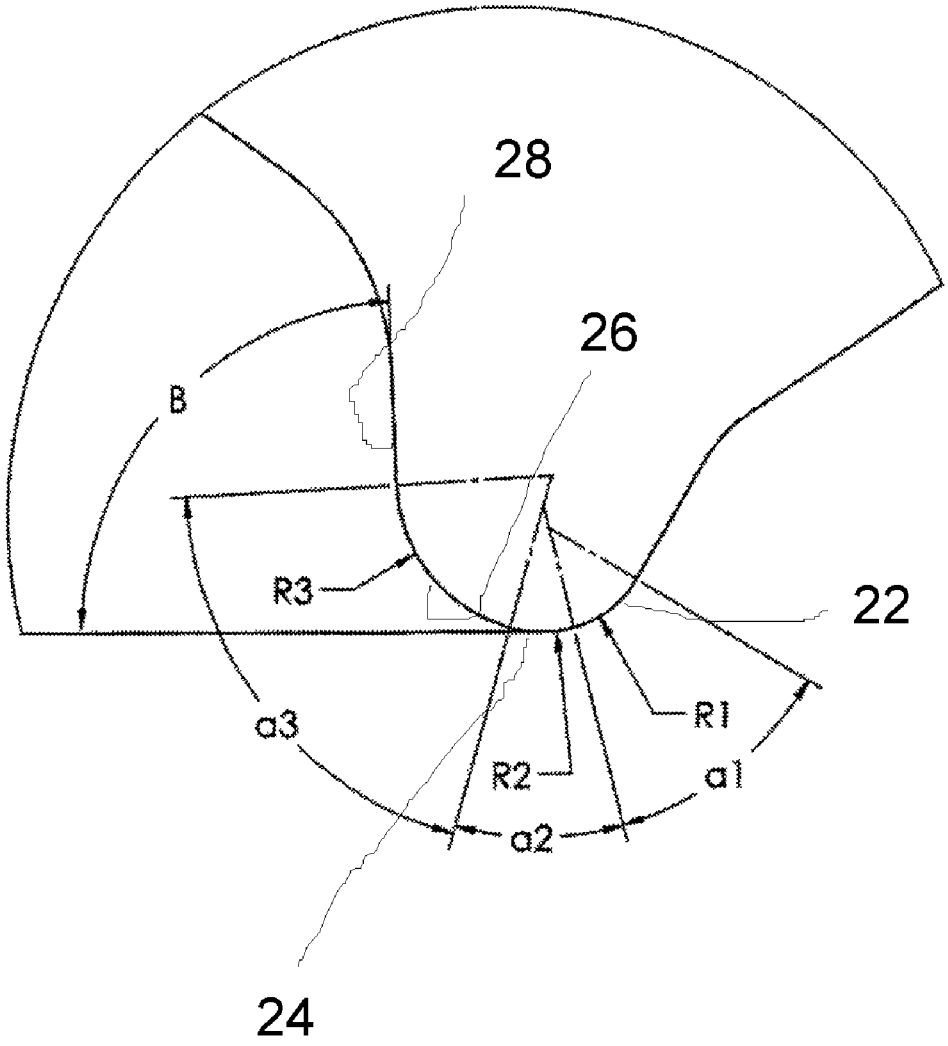
FIG. 3 is an enlarged cross-sectional view of the area that is depicted in the circle 3-3 in FIG. 2.

In the preferred embodiment, the downwardly flanged rim portion 18 includes a first outer convexly curved annular surface 22 that when viewed in vertical cross-section, as shown in FIG. 3, has a first radius of curvature R1 and subtends an angle a1. The first, outer convexly curved annular surface 22 is positioned outwardly with respect to the circular standing ring 20, as is best illustrated in FIG. 3.

The downwardly flanged rim portion 18 also further includes a second lower convexly curved annular surface 24 that when viewed in vertical cross-section as shown in FIG. 3 has a second radius of curvature R2, and subtends an angle a2. In the preferred embodiment, the second lower convexly curved annular surface 24 is located so that it is substantially symmetrical with respect to a vertical axis that extends through the lowermost portion of the circular standing ring 20. Accordingly, the portion of the circular standing ring 20 that is adapted to contact an underlying horizontal surface will be defined by the second lower convexly curved annular surface 24.

The downwardly flanged rim portion 18 also preferably includes a third, inner convexly curved annular surface 26 that when viewed in vertical cross-section as shown in FIG. 3 has a third radius of curvature R3, and subtends a third angle a3. The third, inner convexly curved annular surface 26 is positioned radially inwardly of the substantially circular standing ring 20, as shown in FIG. 3.

Preferably, the first, second and third radii of curvature R1, R2 and R3 are each different from each other. More specifically, the third radius of curvature R3 is preferably greater than the second radius of curvature R2, which in turn is preferably greater than the first radius of curvature R1. Accordingly, the third radius of curvature R3 is preferably greater than said first radius of curvature R1.

Preferably, the substantially circular standing ring has a diameter that is within a range of about 1.2 inches to about 2.0 inches.

By forming the downwardly flanged rim portion 18 as a complex shape having a number of compound curves as viewed in vertical cross-section, the strength of the downwardly flanged rim portion 18 is increased relative to previously known designs that utilized a single radius of curvature. This significantly enhances the strength of the rim portion 18 and increases the resistance to buckling, which enables comparable strength to be achieved at a thinner wall thickness, which permits a significant reduction in material costs and an economic competitive advantage. While in the preferred embodiment the downwardly flanged rim portion 18 is formed of three separate areas having different radii of curvature, similar advantages could be achieved with a design that has two separate areas having different radii of curvature, or four or more separate areas having different radii of curvature, and such alternative embodiments should be considered within the ambit of the invention.

In the preferred embodiment, the first radius of curvature R1 is within a range of about 0.015 inches to about 0.090 inches, and is even more preferably within a range of about 0.025 inches to about 0.070 inches. The second radius of curvature R2 is preferably within a range of about 0.015 inches to about 0.080 inches, and is more preferably within a range of about 0.025 inches to about 0.065 inches. The third radius of curvature R3 is preferably within a range of about 0.015 inches to about 0.090 inches, and is more preferably within a range of about 0.025 inches to about 0.070 inches.

The first radius of curvature R1 preferably subtends a first angle a1 that is within a range of about 5° to about 80°. The second radius of curvature R2 subtends a second angle a2 that is preferably within a range of about 5° to about 50°. The third radius of curvature R3 preferably subtends a third angle a3 that is within a range of about 5° to about 80°. The three different angles a1, a2 and a3 are preferably each different from each other.

The innermost end of the third, inner convexly curved annular surface 26 is unitary with a transition surface 28 that extends inwardly to the recessed or domed central portion 16 of the bottom end wall 14. The transition surface 28 at its interface with the third, inwardly convexly curved annular surface 26 preferably extends at an angle B with respect to a horizontal plane that is within a range of about 50° to about 90°.

The enhanced resistance against buckling that is achieved by the invention permits a wall thickness of the downwardly flanged rim portion 18 to be 0.0108 inches or less. More preferably, the wall thickness of the downwardly flanged rim portion 18 is 0.0107 inches or less. Most preferably, the wall thickness of the downwardly flanged rim portion 18 is 0.0106 inches or less. Conventional designs typically experienced buckling problems at comparable wall thicknesses.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A metallic can, comprising:

a vertically oriented cylindrical sidewall;

an end wall that is unitary with said cylindrical sidewall, said end wall comprising a recessed central portion and a downwardly flanged rim portion that defines a substantially circular standing ring, and where said downwardly flanged rim portion comprises;

a first outer convexly curved annular surface that when viewed in vertical cross-section has a first radius of curvature R1;

a second, lower convexly curved annular surface that when viewed in vertical cross-section has a second radius of curvature R2;

a third, inner convexly curved annular surface that when viewed in vertical cross-section has a third radius of curvature R3; and wherein said first, second and third radii of curvature R1, R2 and R3 are each different from each other; wherein said third radius of curvature R3 is greater than said second radius of curvature R2, wherein said second radius of curvature R2 is greater than said first radius of curvature R1.

2. A metallic can according to claim 1, wherein said third radius of curvature R3 is greater than said first radius of curvature R1.

3. A metallic can according to claim 1, wherein said first radius of curvature R1 subtends a first angle that is within a range of about 5° to about 80°.

4. A metallic can according to claim 1, wherein said second radius of curvature R2 subtends a second angle that is within a range of about 5° to about 50°.

5. A metallic can according to claim 1, wherein said third radius of curvature R3 subtends a third angle that is within a range of about 5° to about 80°.

6. A metallic can according to claim 1, wherein an innermost end of said third, inner convexly curved annular surface extends at an angle with respect to a horizontal plane that is within a range of about 50° to about 90°.

7. A metallic can according to claim 1, wherein said is substantially circular standing ring has a diameter that is within a range of about 1.2 inches to about 2.0 inches.

8. A metallic can according to claim 1, wherein said first radius of curvature R1 is within a range of about 0.015 inches to about 0.090 inches.

9. A metallic can according to claim 8, wherein said first radius of curvature R1 is within range of about 0.025 inches to about 0.070 inches.

10. A metallic can according to claim 1, wherein said second radius of curvature R2 is within a range of about 0.015 inches to about 0.080 inches.

11. A metallic can according to claim 10, wherein said second radius of curvature R2 is within a range of about 0.025 inches to about 0.065 inches.

12. A metallic can according to claim 1, wherein said third radius of curvature R3 is within a range of about 0.015 inches to about 0.090 inches.

13. A metallic can according to claim 12, wherein said third radius of curvature R3 is within a range of about 0.025 inches to about 0.070 inches.

* * * * *